United States Patent [19]

Holmberg

[11] 4,062,091

[45] Dec. 13, 1977

[54] BUCKLE OF VEHICLE SAFETY BELTS, PARTICULARLY VEHICLE SAFETY BELTS FOR CHILDREN

[76] Inventor: Göte Eskil Yngve Holmberg, Postlada 2010, S-330 20 Anderstorp, Sweden

[21] Appl. No.: 693,660

[22] Filed: June 7, 1976

[30] Foreign Application Priority Data

June 9, 1975 Sweden ..... 7506544

[51] Int. Cl.[2] ..... A44B 19/00

[52] U.S. Cl. ..... 24/230 R

[58] Field of Search ..... 24/230 A, 230 AP, 230 AV, 24/230 AS, 230 AL, 230 SC

[56] References Cited

U.S. PATENT DOCUMENTS

| | | | |
|---|---|---|---|
| 3,774,268 | 11/1973 | Holmberg | 24/230 A |
| 3,921,262 | 11/1975 | Tanaka | 24/230 A |
| 3,963,090 | 6/1976 | Hollins | 24/230 A |

FOREIGN PATENT DOCUMENTS

| | | | |
|---|---|---|---|
| 196,035 | 1/1907 | Germany | 24/230 A |

*Primary Examiner*—Paul R. Gilliam
*Assistant Examiner*—K. Dorner

[57] ABSTRACT

In a seat belt buckle a latch member biased to a position of engagement by a pressure spring is operated for disengagement against the combined spring force provided by the pressure spring and a spring member accessible for finger pressure.

5 Claims, 9 Drawing Figures

BUCKLE OF VEHICLE SAFETY BELTS, PARTICULARLY VEHICLE SAFETY BELTS FOR CHILDREN

BACKGROUND OF THE INVENTION

1. Field of the Invention

This invention relates to a seat belt buckle particularly for vehicle safety seat belts for children.

The seat belt buckle according to the invention is of the type comprising a frame substantially enclosed by a casing and having a latch member pivotally mounted to the frame, which is biased to a position of engagement by means of a pressure spring mounted between the frame and the latch member, for engagement with a tongue member inserted into the buckle, said latch member being operable against the bias of the pressure spring to a disengaged position for releasing the tongue member.

2. Description of the Prior Art

In prior art seat belt buckles of this type there is displaceably mounted in the casing a push button for operating the latch member. This push button is accessible through an opening of the casing to be depressed by the finger against the bias provided by said pressure spring when it is desired to release the tongue member from the buckle. A seat belt buckle of this type is disclosed in U.S. Pat. No. 3,774,268 to Holmberg.

The pressure spring of the buckle determines the pressure that has to be exerted on the push button for releasing the tongue member from the buckle. Accordingly, the force of this spring is chosen with consideration of the requirement that the tongue member must not be disengaged due to an unintended light pressure against the push button for example in a collision or under heavy braking and that the buckle shall at the same time be easily and readily operated not only when the safety belt is being taken off but also when it is being put on; the bias provided by the pressure spring, possibly combined with the bias provided by ejection springs, if any, determines the pressure that has to be exerted between the buckle and the tongue member as they are being pushed together when the safety belt is being put on.

In practice it has been found that it is possible to have a rather low operating pressure without neglecting the safety against unintended disengagement of the tongue member except in one case, viz. in case of push button buckles of vehicle or automotive seat belts for children such as are used in special seats for children. Small children often have a tendency to touch things and, therefore, cannot refrain from touching also the seat belt buckle, which in that case can result in depression of the push button so that the tongue member will be released. Should this happen once it is most likely that the child will find some pleasure in depressing the push button repeatedly to release the tongue member which means that the driver or the passengers must keep on securing the child again, and moreover involves a considerable risk that the child is not at any time secured by means of the seat belt and therefore, in an emergency, may lack the necessary protection.

Tests have shown that a child less than five years old is not able to disengage a push button buckle requiring a disengagement pressure of about 7 kg or more. In most cases a disengagement pressure of about 7 kg or more excludes every risk that the child will manage to disengage the buckle on its own but does not necessarily provide any difficulties for an adult (provided, of course, that the pressure required is held within reasonable limits).

SUMMARY OF THE INVENTION

It is a primary object of this invention to provide a new and improved seat belt buckle wherein the disengagement pressure can be adjusted to a desired value independently of the pressure that has to be overcome when the buckle and tongue member are pushed together for interengagement.

It is a further object of this invention to provide a new and improved buckle of seat belts for children in which the disengagement pressure can easily be adjusted to a desired increased value which normally cannot be exerted by a child less than five years old.

A still further object of this invention is to provide a new and improved seat belt buckle in which a push button for operating the buckle is formed by a separate spring member which does not contribute to the spring bias provided for urging the latch member to the engaged position.

Yet another object of this invention is to provide a safety seat belt buckle the parts of which can readily be mounted together.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the seat belt buckle of this invention comprises a frame; a latch member pivotally mounted to the frame, a casing enclosing a substantial part of the frame and forming an insert opening, a tongue member insertable through said opening, a pressure spring biasing the latch member to a position of engagement with said tongue member when inserted through said opening, and an elongated spring member disposed in the casing between the frame and the casing and accessible for finger pressure through an opening formed by said casing, to be resiliently bent transversely towards the latch member for operating the latch member to a disengaged position against the combined spring force provided by said pressure spring and said spring member, for releasing the tongue member.

Preferably the spring member is formed as a leaf spring clamped between the casing and the frame at one end thereof.

It is also preferred that the leaf spring have a projection at the other end thereof at the lower side of the leaf spring, which projection is engageable with the frame or is clamped between the casing and the frame.

In the preferred embodiment of the safety seat belt buckle the spring member forms a push button or finger piece which is to be depressed by a finger when it is desired to release the tongue member.

The accompanying drawings, which are incorporated in and constitute a part of this specification, illustrate embodiments of the invention and, together with the description, serve to explain the principles of the invention.

Figure 1:
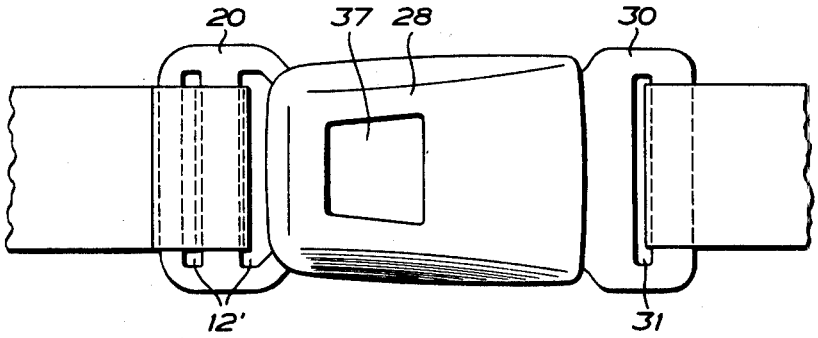
FIG. 1 is a plan view of a buckle according to the invention.
Figure 2:
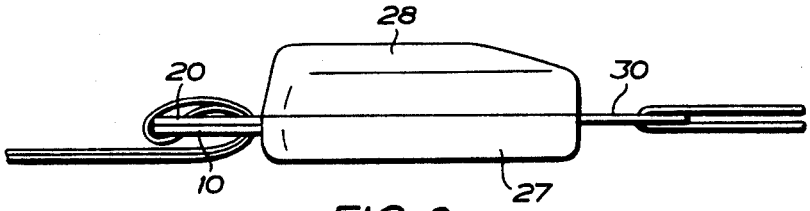
FIG. 2 is a side view of the buckle of FIG. 1.

Reference will now be made in detail to the present preferred embodiments of the invention, examples of which are illustrated in the accompanying drawings.

DESCRIPTION OF THE PREFERRED EMBODIMENTS

The push button buckle disclosed in FIGS. 1 to 6 is constructed basically according to the patent mentioned above and comprises a base plate 10 having opposite marginal flanges 11 and slots 12 for attaching a belt strap. In the base plate there is provided a depression or pocket 13, and in this pocket a latch member or keeper 14 which is bent substantially to Z-form is pivotally mounted by a small projection 15 thereon engaging a slot at the margin of the pocket.

Latch member 14 forms a cross piece 16 providing shoulders 17, and a shaft 18 projecting from said cross piece. This shaft extends through an aperture 19 in a cover plate 20 which is connected to base plate 10 at marginal flanges 11 in the manner described in said patent and which is secured in this position by means of a blocking member 21 which is pivotally connected to the upper side of the cover plate by means of a rivet 22. Blocking member 21 provides a circular portion having three bent-up flaps 23 in order to form a seat for a conical helical pressure spring 24 mounted between the seat and the lower side of shaft 19.

Cover plate 20 forms slots 12′ for attaching the belt strap which are congruent with slots 12 when the cover plate is mounted in position. In base plate 10 there are mounted two helical ejection springs 25 which are received in slots 26.

The frame formed by elements 10 and 20 is substantially enclosed by a sleeve or hollow box casing of plastic material, which comprises a lower casing part 27 and an upper casing part 28 these parts being interconnected by means of rivets or screws one of them passing through a hole 29 and 29′, respectively, in base plate 10 and cover plate 20, respectively. The casing forms a slot-like insert opening 28*a* at one end of the casing, the portions of base plate 10 and cover plate 20 which form slots 12 and 12′, respectively, projecting from the other end of the casing.

The buckle is intended to co-operate in a known manner with a tongue member or leaf 30 which forms a slot 31 at one end thereof for attaching a belt strap, and provides shoulders 32 in the forked other end thereof for engagement with shoulders 17 of latch member 14 when the tongue member is inserted between the base plate and the cover plate through opening 28*a* of the casing. Springs 25 eject the tongue member from the buckle when spring-urged latch member 14 is depressed at shaft 18 against the bias provided by pressure spring 24.

Figures 4, 5:
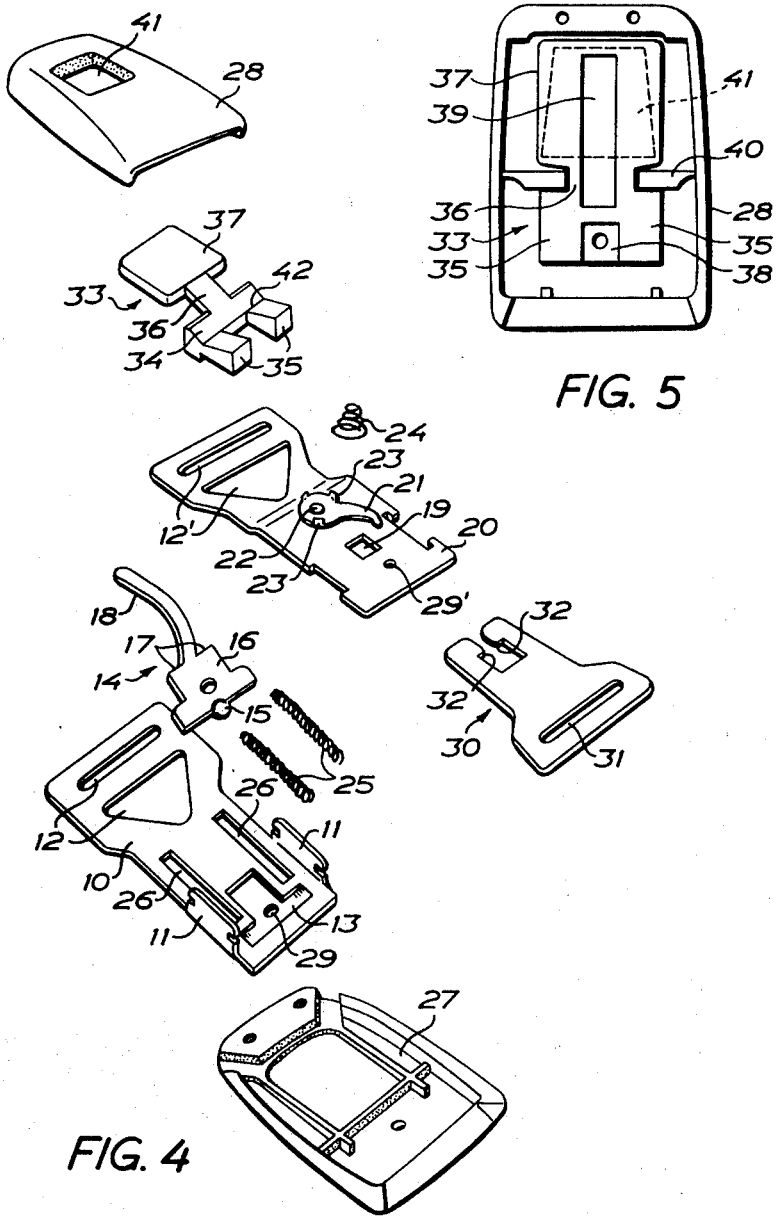
FIG. 4 discloses the buckle of FIGS. 1 to 3 in an exploded perspective view.
FIG. 5 is a plan view of the lower side of the upper casing part the spring member being disposed therein.
Figure 6:
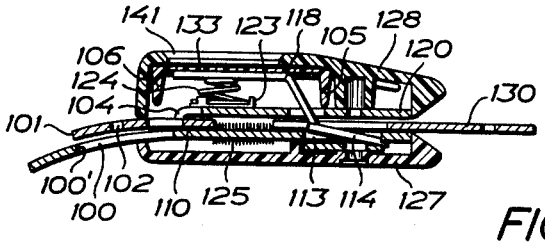
FIG. 6 is a longitudinal sectional view of a modified buckle according to the invention.
Figure 7:
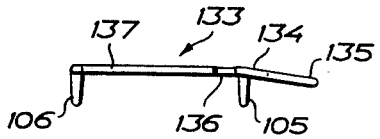
FIG. 7 is a side view of the spring member of the buckle of FIG. 6.
Figure 8:
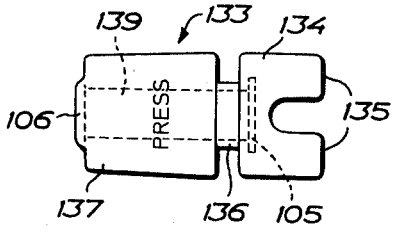
FIG. 8 is a plan view of the spring member of FIG. 7.
Figure 9:
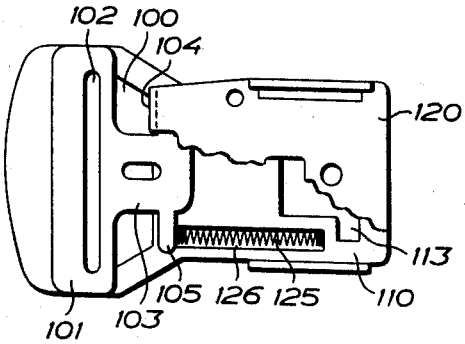
FIG. 9 is a plan view, partly in section, of the frame of the buckle of FIG. 6 and parts mounted therein.

For the operation of latch member 14 there is provided a spring member 33 of plastic material, which comprises a cross piece 34 having two projections 35 at one side of the cross piece and a shaft 36 at the other side thereof. A flat portion 37 joins the shaft. Spring member 33 is substantially Z-formed and is clamped at cross piece 34 and projections 35 between upper casing part 28 and cover plate 20. Preferably, a hollow stub 38, FIG. 5, provided on the lower side of said casing part for the passage of the rivet or screw passing through holes 29 and 29′ is received between cross piece 34 and the projections 35 as will be seen in FIG. 5, in order to determine the correct position of spring member 33 in the buckle. Shaft 36 has U-formed cross sectional form a longitudinal groove 39 being provided in the lower side of member 33 along the shaft and the flat portion thereof. The shaft extends through an opening in a web 40 on the lower side of casing part 28. Portion 37 is received in a recess in the lower side of said casing part and covers completely an opening 41 therein, through which said portion is accessible to be pressed by the finger. Portion 37 is thus located between upper casing part 28 and latch member 14 and displaceably receives shaft 18 of the latch member in groove 39 the bottom of which is contacted by shaft 18 under the bias provided by pressure spring 24.

Thus, the flat portion 37 provides a push button or finger-piece of the buckle described for the depression of spring member 33 which forms a spring of cantilever type clamped at one end thereof between cover plate 20 and upper casing part 28. This spring member is rather stiff and, therefore, provides a heavy resistance against depression of portion 37. By suitable form and/or dimensions of the spring member the stiffness thereof can be adjusted in such a manner that the resistance against depression of portion 37 corresponds to at least 7 kg or any other force that may be prescribed by the authorities. This adjustment can be made for example by varying the form and depth of a V-shaped groove 42 provided on the upper side of the spring member. This groove also provides an improved clamping of the spring member due to the fact that said member engages casing part 28 along two parallel sharp edges or ridges. The resistance against depression of portion 37 forming a push button on spring member 33 will be provided by said spring member and pressure spring 24 in combination. However, the resistance provided by spring 24 can be made considerably smaller than that provided by spring member 33 and has to be dimensioned only to be sufficiently large for returning latch member 14 to the position of engagement when the pressure against portion 37 ceases.

Thus, it is possible to considerably increase the resistance encountered at the operation of the buckle for releasing the tongue member by the arrangement described without increasing the pressure which has to be exerted at the insertion of the tongue member into the buckle and which is determined only by pressure spring 24 and ejection springs 25.

A separate element can be attached to spring member 33 to form a push button or finger piece thereon or can be displaceably guided in the upper casing part 28.

The buckle disclosed in FIGS. 6 to 9 comprises in the same manner as the buckle described above a base plate 110 forming a pocket 113 in which there is pivotally mounted a latch member 114 having a shaft 118 projecting therefrom. A cover plate 120 is mounted to the base plate in the manner described above, and in elongated slots 126 in the base plate there are mounted ejection springs 125. The frame comprising elements 110 and 120 is enclosed by a casing of plastic material comprising a lower casing part 127 and an upper casing part 128 said parts being interconnected by means of rivets or the like. Latch member 114 is biased by means of a pressure spring 124 mounted between a seat 123 on cover plate 120 and shaft 118.

For the attachment of the belt strap to the buckle there is provided in the base plate 110 an opening 100 and there is provided on the upper side of the base plate a displaceable strap slide 101. This strap slide has a slot 102 for the passage of the strap and is formed with a neck portion 103, the slide being displaceably guided by means of said neck portion between shoulder tabs 104 on cover plate 120. The slide can be engaged with ejection springs 125 by means of two side projections 105, and these projections also limit the movement of the strap slide under the bias of the ejection springs by engaging shoulder tabs 104. When the tongue member is inserted into the buckle the ejection springs are compressed and thereby the bias on strap slide 101 will be increased so that it will securely clamp a belt strap passed through opening 100 and slot 102 against edge 100' of said opening.

A thin resilient plate 133 of plastic material forms a wider end portion 134 providing two mutually spaced flaps 135, at one side of a narrower portion 136, and a wider portion 137 at the other side of portion 136. Portion 134 including flaps 135 is angled to some degree in relation to the rest of the plate. The plate is positioned in upper casing part 128 by means of webs provided on the lower side of said casing part in the same manner as that in which element 33 in the embodiment according to FIGS. 1 to 5 is positioned, such webs being received in the notches provided between flaps 135 and portions 134 and 137. On one side of the plate, viz. the side which is intended to be the lower side of the plate when it is mounted in the buckle there is provided a projecting cross flange 105 on portion 134 and another cross flange 106 at the end of portion 137. The plate is clamped at flange 105 between cover plate 120 and upper casing part 128, portion 134 including flaps 135 engaging the lower side of said casing part or is close to said lower side. In the lower side of plate 130 there is provided a shallow linear groove 139 for receiving shaft 118 of latch member 114.

Thus it will be seen that plate 133 forms in fact a leaf spring fixedly secured in the buckle at one end and projecting in a cantilever fashion from said end. Portion 137 is accessible through an opening 141 in casing part 128 to be depressed by a finger and thus forms the push button or finger piece of the buckle. Such depression will take place under the resilient yielding of plate 133.

Flange 106 can engage the upper side of strap slide 101 when flange 105 is clamped between cover plate 120 and upper casing part 128 but it can also be spaced a small distance from the strap slide in order to abut said slide by an initial resilient movement of plate 133 when a pressure is exerted against portion 137. However, such movement must not be so great that the latch member will be actuated to disengaged position for releasing the tongue member shown at 130 in FIG. 9. This will be achieved by resilient deformation of plate 133 between flanges 105 and 106 due to an increased pressure against portion 137, plate 133 thus providing the resistance against operation of latch member to disengaged position supplementary to that provided by spring 124. As will be seen tongue member 130 can be released only against the combined action of pressure spring 124 and spring member 133.

Figure 3:
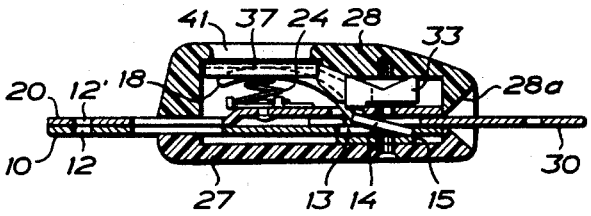
FIG. 3 is a longitudinal sectional view of the buckle of FIGS. 1 and 2.

By the arrangement disclosed in FIGS. 6 to 9 it is achieved that the pressure necessary for releasing the tongue member is substantially the same independently of the pressure being exerted near one edge or the other of portion 137 of spring member 133, which forms the push button or finger piece for operating the buckle. In the embodiment according to FIGS. 1 to 5 a remarkably lower pressure may be sufficient for releasing the tongue member if spring member 33 is actuated at the left side edge, as seen in FIG. 3, than if it is actuated at the right side edge.

It will be apparent to those skilled in the art that various other modifications and variations in addition to those mentioned above could be made in the buckle of the invention without departing from the scope and spirit of the invention.

I claim:

1. A seat belt buckle comprising a frame; a latch member pivotally mounted to the frame; a casing enclosing a substantial part of the frame and forming an insert opening; a tongue member insertable through said opening; a first pressure spring biasing the latch member to a position of engagement with said tongue member when inserted through said opening; a finger-access opening formed by said casing; and a second elongated resilient spring member separate and detached from the latch member and disposed in the casing and clamped between the frame and the casing in a manner to be bendable towards the latch member but to resiliently resist such bending, and accessible for finger pressure through said opening to be resiliently bent against its spring force transversely towards the latch member, the latch member being interposed between the first pressure spring member and the second elongated resilient spring; the second elongated resilient spring member operating the latch member to a disengaged position only against the combined spring force provided by said pressure spring and said elongated resilient spring member, for releasing the tongue member.

2. A buckle as claimed in claim 1 wherein the elongated resilient spring member is clamped at one end thereof between the frame and the casing.

3. A buckle as claimed in claim 1 wherein the elongated resilient spring member comprises a plastic element forming a flat englargement operable as a push button.

4. A buckle as claimed in claim 1 wherein the elongated resilient spring member comprises a groove on its inner side, and the latch member biased by said pressure spring is displaceably guided in said groove.

5. A buckle as claimed in claim 1 wherein the elongated resilient spring member is formed as an elongated resilient plate which is clamped at a portion at one end thereof between the casing and the frame, a projection being provided at the other end of the plate on the lower side thereof, which projection is engageable with the frame, the portion of the plate which is located between the clamped portion and said projection providing a push button for operating the buckle.

* * * * *

UNITED STATES PATENT OFFICE

CERTIFICATE OF CORRECTION

Patent No. 4,062,091 Dated December 13, 1977

Inventor(s) Gote Eskil Yngve Holmberg

It is certified that error appears in the above-identified patent and that said Letters Patent are hereby corrected as shown below:

Column 3, line 24 : "6" should be --5--.

Column 6, line 52 : "englargement" should be --enlargement--

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*